US005211468A

United States Patent [19]

Jeng

[11] Patent Number: 5,211,468

[45] Date of Patent: May 18, 1993

[54] SCREW DRIVER HAVING AN ILLUMINATING UNIT MOUNTED THERETO

[76] Inventor: Jong-Pyng Jeng, No. 9-1, Ting-Nan, Ying-Chuan Li, Huwei Chen, Yunlin Hsien, Taiwan

[21] Appl. No.: 940,524

[22] Filed: Sep. 4, 1992

[51] Int. Cl.[5] ..... B25B 23/18

[52] U.S. Cl. ..... 362/120; 362/109

[58] Field of Search ..... 362/109, 119, 120, 253; 7/165; 81/177.4, 436

[56] References Cited

U.S. PATENT DOCUMENTS 3,919,541 11/1975 Chao ..... 362/120

5,124,893 6/1992 Jeng ..... 362/120

*Primary Examiner*—Ira S. Lazarus

*Assistant Examiner*—Alan B. Cariaso

*Attorney, Agent, or Firm*—Darby & Darby

[57] ABSTRACT

A screw driver includes an illuminating unit fixed to a slidable member that is slidably mounted on a shank of the screw driver. An insulating sleeve member is provided around one end of the shank adjacent to the handle so as to serve as an on/off button switch.

5 Claims, 9 Drawing Sheets

SCREW DRIVER HAVING AN ILLUMINATING UNIT MOUNTED THERETO

BACKGROUND OF THE INVENTION

1. Field of Invention

The invention relates to a screw driver, more particularly to a screw driver which includes a handle and an illuminating unit fixed to a slidable member that is mounted slidably on a shank attached to the handle, which shank has an insulating sleeve member provided thereon adjacent to the handle.

2. Description of the Related Art

According to U.S. Pat. No. 5,124,893, there is disclosed a screw driver which includes a handle (A) and a shank (B) having a front end with a tip (B1) for turning a screw and a rear end (B2) fixed to a front end of the handle (A). The handle (A) confines a receiving space to receive a cell means (C) and is provided with an illuminating unit (E) and a connecting means (F) for connecting electrically the illuminating unit (E) to the cell means (C). The screw driver further includes a slidable member (D) mounted slidably on the shank (B). The illuminating unit (E) is fixedly mounted on the slidable member (D). An on-off button switch (G) is operated to actuate the illuminating unit (E).

A main drawback of the above-mentioned screw driver is that the on-off button switch (G) is disposed on the handle (A). In order to provide the button switch (G) on the handle (A), a special mold is required so as to produce the handle (A), which has a particular receiving recess to accommodate the button switch (G). Making a mold with a particular feature is more expensive than constructing a mold with a simple structure.

SUMMARY OF THE INVENTION

A main object of the present invention is to provide a screw driver which possesses all the characteristics similar to that disclosed in the above-mentioned U. S. Patent, and which screw driver has an insulating sleeve member provided on the shank adjacent to the handle of the screw driver so as to serve as an on-off button switch.

According to the present invention, the screw driver includes a handle and a shank having a front end with a tip for turning a screw and a rear end fixed to a front end of the handle. An insulating sleeve member is disposed on the rear end of the shank. The handle confines a compartment to receive a cell means with a positive terminal connected to the rear end of the shank and a negative terminal. The screw driver further includes a slidable member mounted slidably on the shank and carrying an illuminating unit at a front portion thereof, and means for electrically connecting the illuminating unit to the cell means. The connecting means includes a coil of wire having a first end connected to the negative terminal of the cell means, and a conducting clamp disposed within the slidable member and clamping the shank. The illuminating unit includes a first electrode connected to the conducting clamp of the slidable member and a second electrode connected to the second end of the wire. When the slidable member is moved adjacent to the front end of the handle, the insulating sleeve member is disposed between the conducting clamp in the slidable member and the shank, thereby breaking electrical connection between the conducting clamp and the shank.

BRIEF DESCRIPTION OF THE DRAWINGS

Other features and advantages of the present invention will become more apparent in the following detailed description, including drawings, all of which show a non-limiting form of the present invention, and in which.

DETAILED DESCRIPTION OF THE PREFERRED EMBODIMENT

Figure 1:
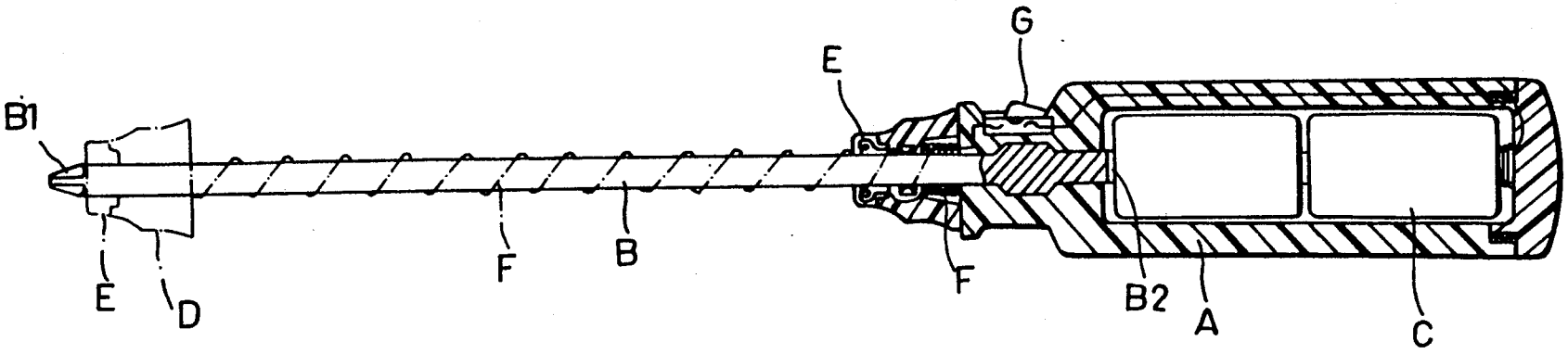
FIG.1 PRIOR ART
FIG. 1 illustrates the screw driver disclosed in U.S. Pat. No. 5,124,893.
Figure 2:
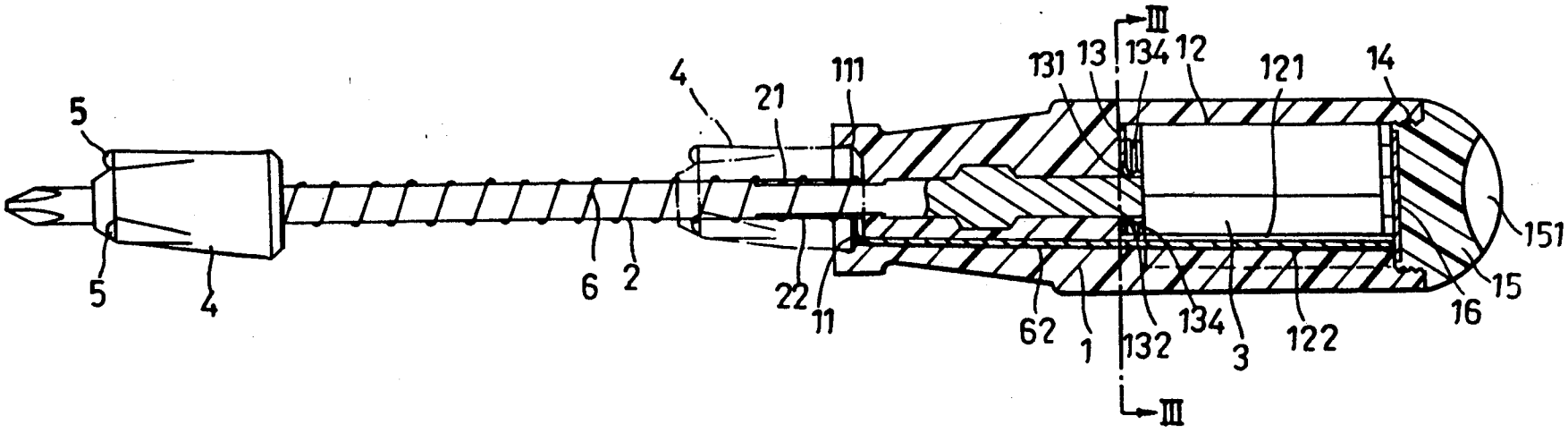
FIG. 2 illustrates a screw driver of the present invention.
Figure 3:
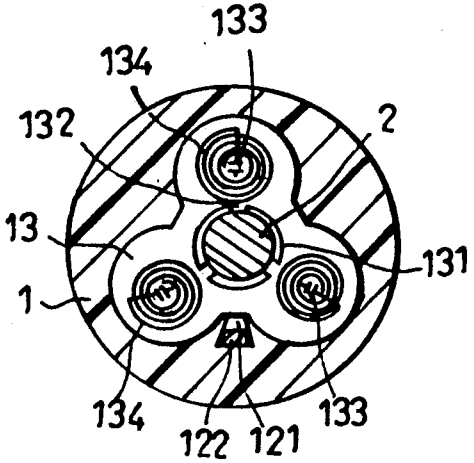
FIG. 3 is a cross sectional view of the handle of the screw driver of the present invention taken along the line III—III in FIG. 2.
Figure 4:
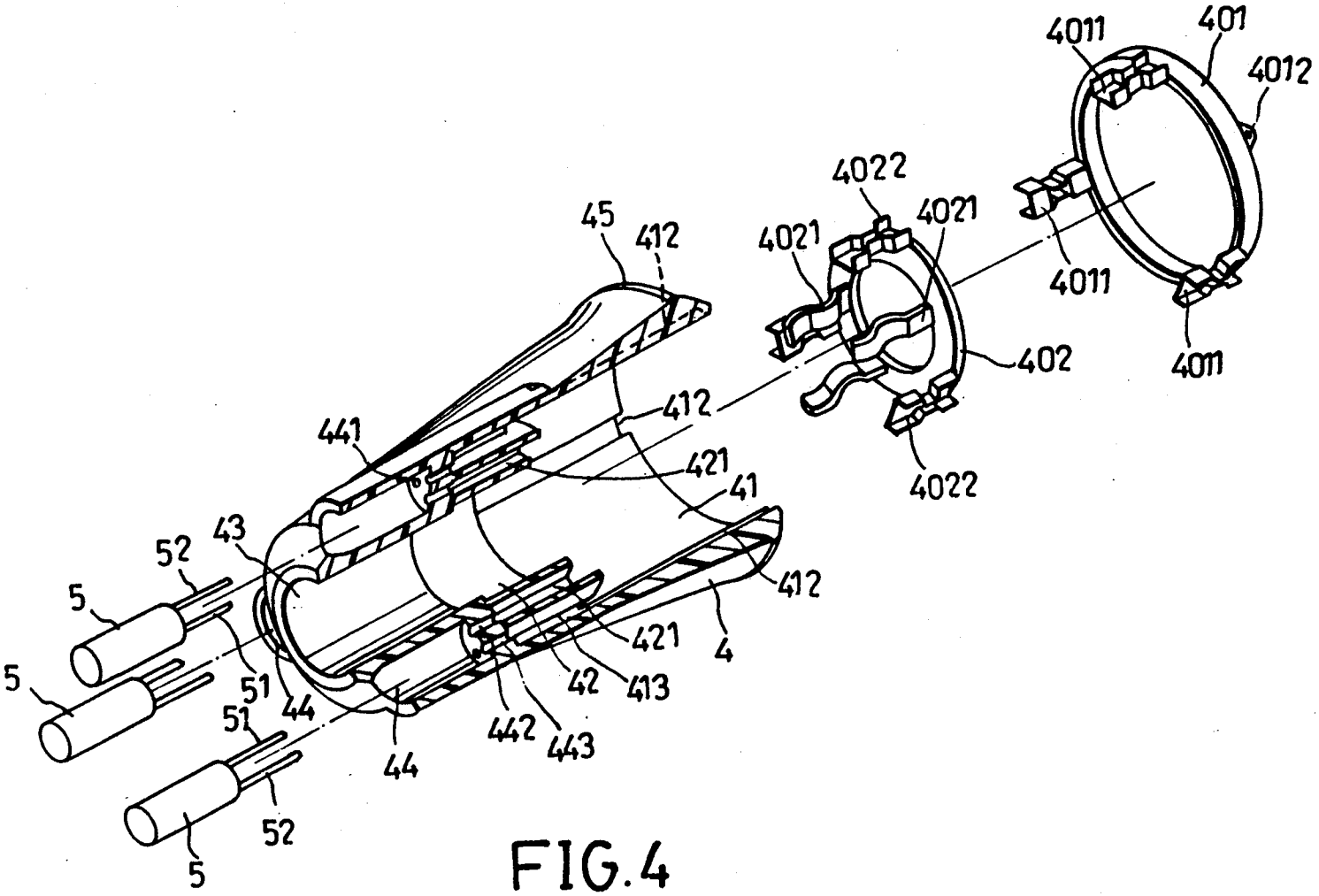
FIG. 4 is an exploded view of a slidable member mounted slidably on the shank of the screw driver illustrated in FIG. 2.
Figure 5:
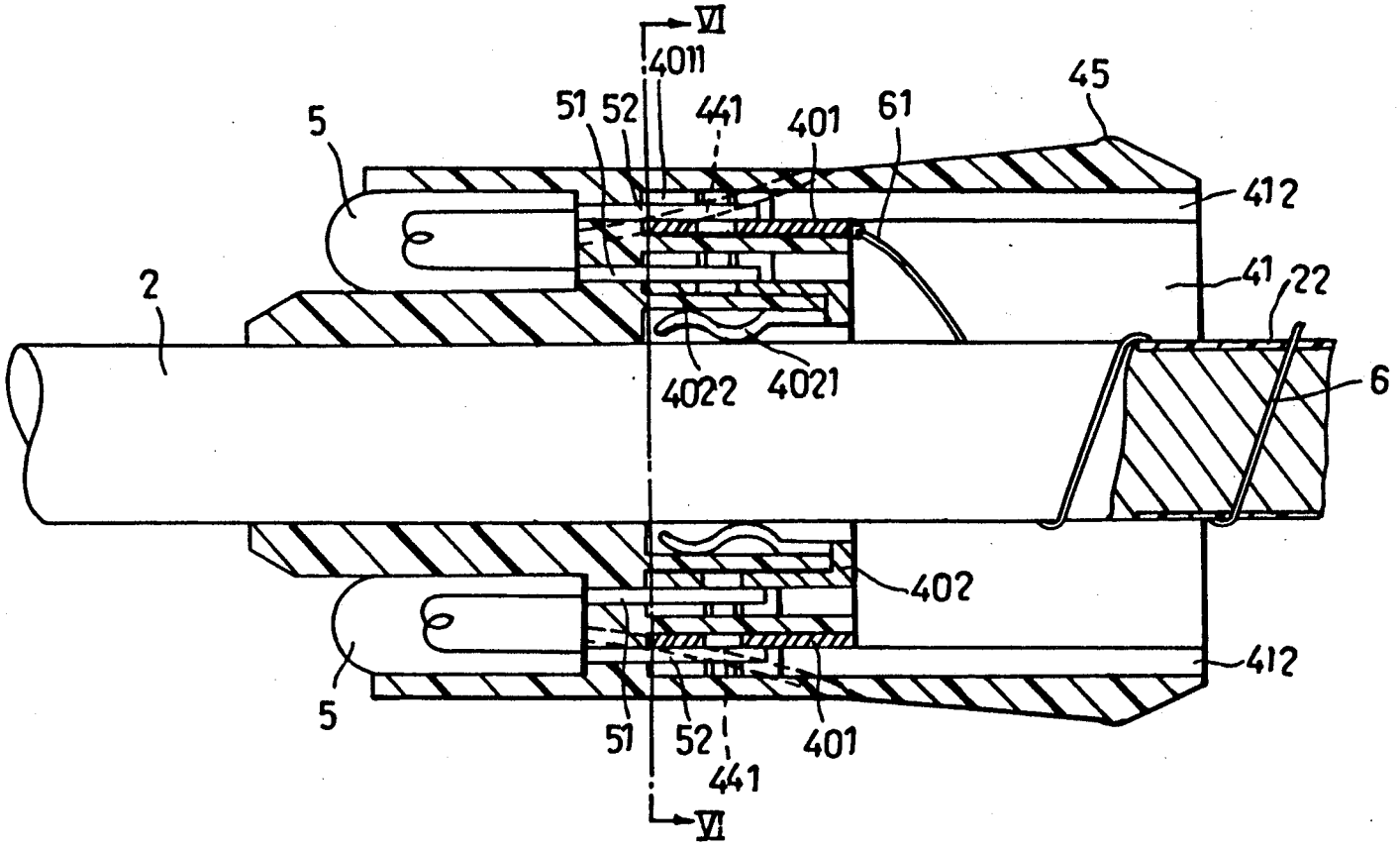
FIG. 5 shows a cross sectional view of a slidable member of the screw driver of the present invention.
Figure 6:
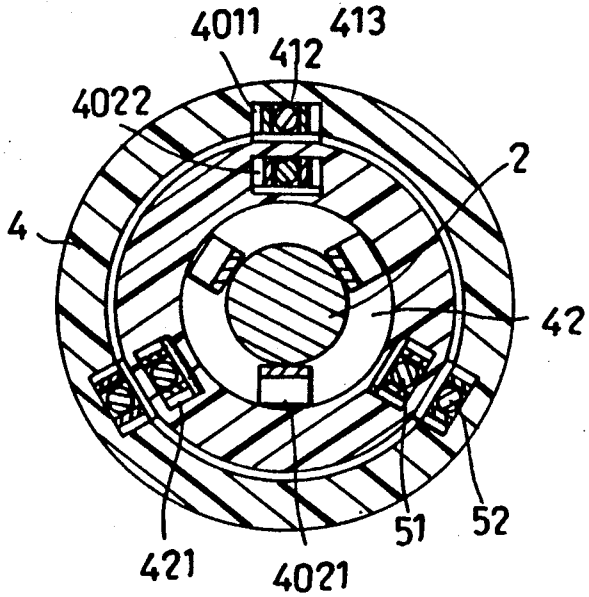
FIG. 6 shows a cross sectional view of the slidable member of the screw driver of the present invention taken along the line VI—VI of FIG. 5.

Referring to FIGS. 2 and 3, a screw driver of the present invention is shown to comprise a handle (1), a shank (2) having a first end with a tip portion for turning a screw and a rear end fixed to a front end of the handle (1), a cell means (3), a slidable member (4), an illuminating unit (5) and a coil of insulated wire (6).

Since the screw driver of the present invention is an improvement of the ones disclosed in U.S. Pat. No. 5,124,983, only the improved parts will be described herein.

The handle (1) is generally shaped as a hollow cylinder and confines a compartment (12) to receive the cell means (3). The bottom end of the compartment (12) is capped by a plastic lid (15) which has a metal plate (16) on an inner side thereof to abut against a first terminal end of the cell means (3) and a recess section (151) formed in an outer side thereof so that the lid (15) may be removed from the handle (1) by inserting a coin in the recess section (151) in order to turn the lid (15). The handle (1) further has an elongated axial slot (121) formed on an inner wall of the handle (1) and receiving a metal strip (122) therein. One end of the metal strip (122) is connected to the metal plate (16).

A metal plate (13) with a central hole (131) is disposed at a front end of the compartment (12). The metal plate (13) has three clamps (132) formed around the periphery of the central hole (131) and clamping the shank (2). The metal plate (13) also has three coiled springs (134) which engage three hooks (133) formed thereon to bias the outer periphery of the second terminal of the cell means (3) to contact the rear end of the shank (2).

The shank (2) has an annular recess (21) formed on the rear end thereof adjacent to the front end of the handle .(1). An insulating sleeve member (22) is disposed on the rear end of the shank (2) such that topmost surfaces of the insulating sleeve member (22) and the shank (2) are flushed with one another, thereby facilitating sliding movement.

The slidable member (4) in the preferred embodiment is a cylindrical member which has an axial bore (43) extending therethrough and which is slidably provided on the shank (2). The axial bore (43) is divided into a first section formed adjacent to a front end of the cylindrical member with a predetermined inner diameter, a second section (42) adjacent to the first section with an inner diameter larger than the first section and a third section (41) adjacent to the second section (42) and having an inner diameter larger than the second section (42). The first section of the cylindrical member has three equally-spaced axially extending first chambers (44) formed on an inner wall of the first section. Each of the first chambers (44) has a tiny hole (441) therethrough, the purpose of which will be described later The second section (42) of the cylindrical member includes three equally-spaced and axially extending second chambers (421) formed on an inner wall thereof and respectively communicated with the first chambers (44). The third section (41) of the cylindrical member includes three equally-spaced and axially extending third chambers (413) formed on an inner wall thereof and respectively communicated with the second chambers (421). A first conducting disc (402) is disposed in the second section (42) of the cylindrical member and has three equally-spaced clamp members (4021) that extend from an inner periphery of the disc (402) to clamp the shank (2) and three equally-spaced first terminals (4022) received in the second chambers (421). A second conducting disc (401) is disposed in the third section (41) and has three equally-spaced second terminals (4011) received in the third chambers (413).

The illuminating unit includes three light bulbs (5) respectively received in the axially extending first chambers (44). Each of the light bulbs (5) has a first conductive end (51) which extends through a first hole (442) in the bottom of the first chamber (44) so as to connect with the first terminal (4022) in the second chamber (421), and second end (52) which extends through a second hole (443) in the bottom of the first chamber (44) so as to connect with the second terminal (4011) in the third chamber (413). The connecting wire (6) has one end (61) connected to an ear (4012) of the second conducting disc (401) and another end (62) connected a front end of the metal strip (122).

After assembly, the light bulbs (5) are at an on state sine the positive and negative terminals of the cell means (3) are connected to form a closed circuit. Movement of the slidable member (4) to a position adjacent to the front end of the handle (1) causes wherein the insulating sleeve member (22) to be disposed between the clamp members (4021) of the first conducting disc (402) and the rear end of the shank (2), thereby disconnecting electrically the clamp members (4021) from the shank (2).

In the event that the light bulb (5) is not functioning and is to be replaced by a new one, a small wire can be inserted into the first chamber (44) from the second chamber (421) through the hole (441) so as to push and remove the bulb (5) from the first chamber (44).

Figure 7:
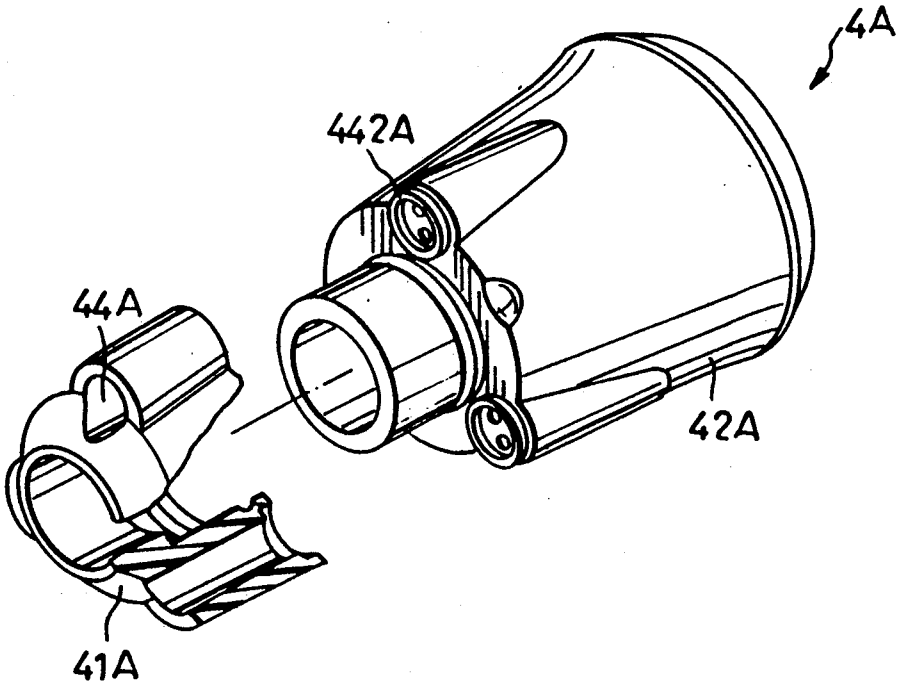
FIG. 7 shows another preferred embodiment of the slidable member of the screw driver of the present invention.
Figure 8:
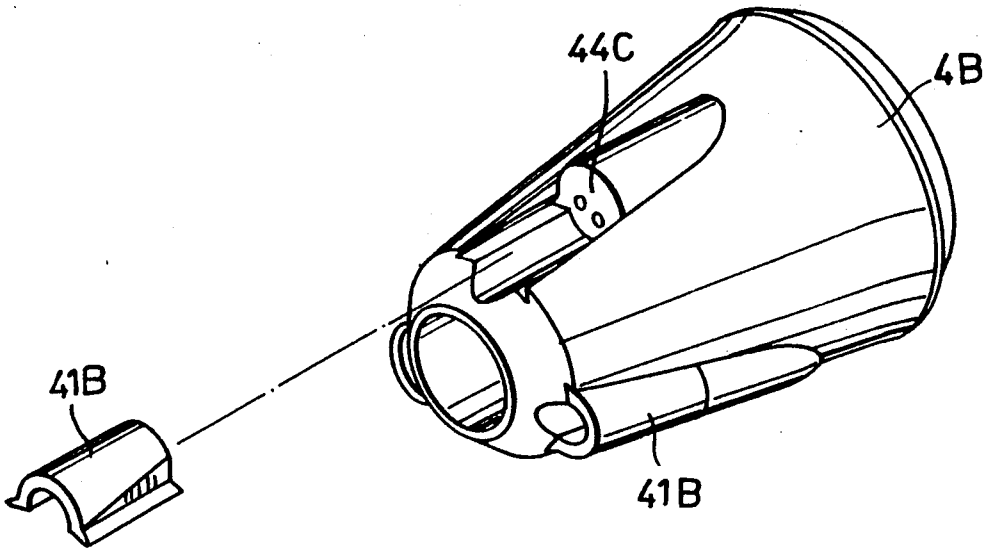
FIG. 8 shows still another preferred embodiment of the slidable member of the screw driver of the present invention.

Referring to FIG. 7, in order to facilitate removal of the light bulb from the first chamber, the slidable member (4A) can be constructed into a rear part (42A), which includes the bottom (442A) of the first chamber (44A), and a front part (41A) which has an enclosed wall that cooperates with the bottom (442A) to confine the first chamber (44A). The front and rear part can be joined together by male-female connection.

In another embodiment, the slidable member (4B) is a single unit, the bottom (44C) of the first chamber is formed on an outer surface of the slidable member. A curved piece (41B), which can slidably and detachably engage the outer surface of the slidable member (4B) so as to confine the first chamber for receiving a light bulb therein, is separately provided.

Figure 9:
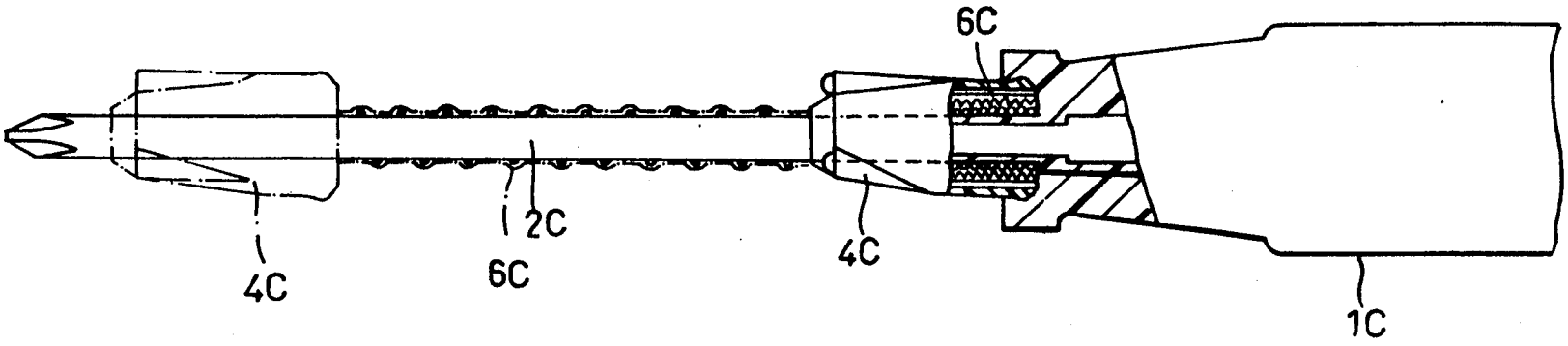
FIG. 9 illustrates a screw driver of the present invention shown equipped with a sheathed connecting wire.

Referring to FIG. 9, the connecting wire (6) employed in the slidable member (4C) is sheathed and is disposed around the shank (2C) in a helical manner such that when the slidable member (4C) is moved adjacent to the front end of the handle (1C) in order to turn off the light bulb, the wire (6) coils within the slidable member (4).

While a preferred embodiment has been illustrated and described, it will be apparent that many changes and modifications may be made in the general construction and arrangement of the present invention without departing from the spirit and scope thereof. Therefore, it is desired that the present invention should not be not limited to the exact disclosure but only to the extend of the appended claims.

I claim:

1. A screw driver including a handle and a shank having a front end with a tip for turning a screw and a rear end fixed to a front end of said handle, said handle confining a compartment for receiving a cell means with a positive terminal connected to said rear end of said shank and a negative terminal, said screw driver further having a slidable member mounted slidably on said shank, an illuminating means fixed on a front portion of said slidable member, means for connecting electrically said illuminating means and said cell means including a coil of wire having a first end connected to said negative terminal of said cell means, and a conducting clamp disposed within said slidable member and clamping said shank, said illuminating means having a first electrode connected electrically to said conducting clamp of said slidable member and a second electrode connected electrically to a second end of said wire;

wherein the improvement comprises: said shank further includes an insulating sleeve member disposed on said rear end of said shank such that when said slidable member is moved to said rear end of said shank adjacent to said front end of said handle, said insulating sleeve member is disposed between said rear end of said shank and said conducting clamp in said slidable member, thereby disconnecting electrically said conducting clamp and said shank.

2. A screw driver as defined in claim 1, wherein said rear end of said shank has an annular recess formed therearound and said insulating sleeve member is disposed in said annular recess such that topmost surfaces of said insulating sleeve member and said shank are flushed with one another.

3. A screw driver as defined in claim 1, wherein said front end of said handle has a receiving recess formed thereat and said slidable member includes an engaging projection formed at a rear end of said slidable member, said engaging projection engages said receiving recess of said handle when said slidable member is moved adjacent to said front end of said handle.

4. A screw driver as defined in claim 1, wherein:

said illuminating means includes three light bulbs;

said slidable member is an elongated cylindrical member and has an axial through bore extending therethrough, said elongated cylindrical member being divided into a first section with a predetermined inner diameter adjacent to a front end of said through bore, a second section adjacent to said first section and which has an inner diameter larger than that of said first section, and a third section adjacent to said second section and which is larger than said second section;

three equally-spaced axial first chambers being formed in inner wall of said first section and receiving respectively said three light bulbs therein;

three equally-spaced axial second chambers being formed on an inner wall of said second section and being respectively communicated with said axial first chambers;

three equally-spaced axial third chambers being formed on an inner wall of said third section and being respectively communicated with said axial second chambers;

said conducting clamp including: a first circular disc which has three equally-spaced clamp members extending from an inner periphery of said first circular disc to clamp said shank and three equally-spaced first terminals, each of which is received in a respective one of said axial second chambers;

a second circular disc connected to said second end of said wire and having three equally-spaced second terminals extending therefrom, each of which is received in a respective one of said third axial chambers; and each of said light bulbs including a first conductive end which extends into said second chamber to connect with a respective one said first terminals and a second conductive end which extends into said second chamber to connect with a respective one of said second terminals.

5. A screw driver as defined in claim 4, wherein each of said axial first chambers has a bottom which is provided with a through hole connected to said second chamber.

* * * * *